United States Patent [19]

Klooster

[11] 4,161,973

[45] Jul. 24, 1979

[54] DEVICE FOR FASTENING A CHISEL TO A ROTATABLE CHISEL BLOCK OF A WOOD WORKING MACHINE

[75] Inventor: Leefert Klooster, De Wijk, Netherlands

[73] Assignee: L. Klooster & Zonen B.V., Zaandam, Netherlands

[21] Appl. No.: 849,350

[22] Filed: Nov. 7, 1977

[51] Int. Cl.[2] ..... B27G 13/04

[52] U.S. Cl. ..... 144/224; 83/698; 144/218; 144/230; 241/192; 407/44

[58] Field of Search ..... 241/192; 83/698, 699, 83/700; 407/44, 48, 51; 144/218, 224, 225, 226, 227, 230, 229

[56] References Cited

U.S. PATENT DOCUMENTS

| | | | |
|---|---|---|---|
| 271,199 | 6/1883 | Green | 144/224 |
| 400,567 | 4/1889 | Haskell | 144/224 |
| 1,716,192 | 6/1929 | Schupp | 144/224 |

*Primary Examiner*—Donald R. Schran
*Assistant Examiner*—W. D. Bray
*Attorney, Agent, or Firm*—John P. Snyder

[57] ABSTRACT

A device for fastening a chisel to a rotatable chisel block of a wood working machine by means of a clamping bolt engaging a fastening slot in the chisel block, the shank of said bolt extending through an elongated hole in the chisel and by means of a clamping plate holding the chisel and having a transverse extension supporting set screws which engage a rearwardly diverging safety face of the chisel wherein the transverse extension has safety cams engaging recesses in the fastening slot so that the transverse extension is locked in place in a radial direction.

5 Claims, 4 Drawing Figures

FIG.1
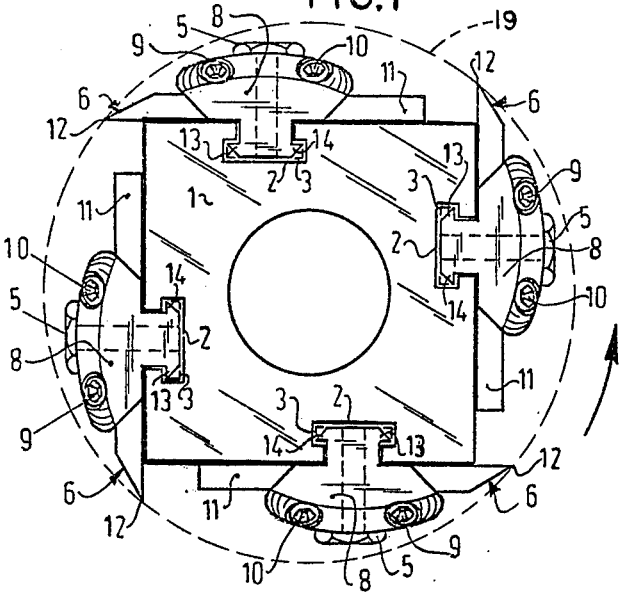
FIG.3
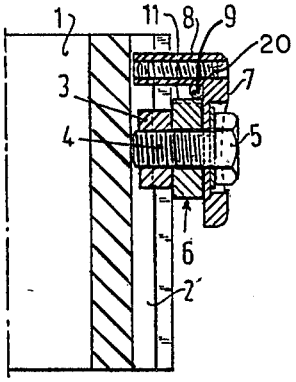
FIG.2
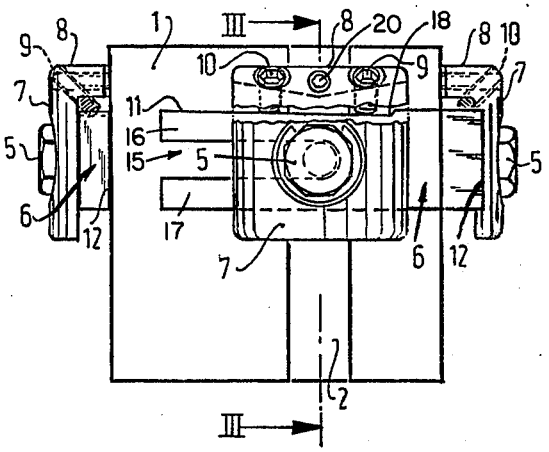
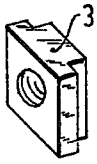
FIG.4

DEVICE FOR FASTENING A CHISEL TO A ROTATABLE CHISEL BLOCK OF A WOOD WORKING MACHINE

The invention relates to a device for fastening a chisel to a rotatable chisel block of a wood working machine by means of a clamping bolt engaged in a fastening slot in the chisel block, the shank of said bolt extending through an elongated slot in the chisel, and by means of a clamping plate holding the chisel and having a transverse extension supporting set screws engaging a rearwardly diverging safety face of the chisel.

Such a device is known from Dutch Patent Specification No. 120,575. Although such a fastening device operates satisfactorily in practice, there is a risk that in the event of breakage of the clamping bolt the device and the chisel held therein disengage from the chisel-block.

The invention has for its object to eliminate this disadvantage. According to the invention this is achieved by providing the transverse extension with safety cams engaging recesses in the fastening slot so that the transverse extension is locked in position in a radial direction. In the event of rupture of the clamping bolt the device is retained by the cams on the chisel block so that the chisel cannot get loose. This precaution permits of disposing the set screws in an inclined position relative to the fastening slot, since owing to the locking in a radial direction by means of the safety cams the clamping plate cannot move upwardly. Hitherto a component in a radial direction had to be avoided. The inclined position of the set screws provides an easier access for mounting purposes.

Owing to the presence of the safety cams the thickness of the chisel to be mounted is accurately determined. Hitherto it has been required for reasons of safety to use a clamping bolt engaging the fastening slot by its head and a nut to be screwed onto the top end in order to ensure that the nut was screwed onto the bolt throughout its screwthread. The enhanced safety obtained by means of the safety cams permits of using a bolt screwed into the screwthread of a T-nut engaging the fastening slot. With the comparatively large thickness of the fastening slot a comparatively great length of screwthreads may be chosen without any objection. This has the advantage that on the top side the clamping bolt projects out of the clamping plate by a minimum length, that is to say, the thickness of the head so that in order to obtain a given cutting circle the length of the chisel in a tangential direction may be kept small, its non-supported portion being, therefore, short. This improves safety.

The invention will be described in detail by way of example with reference to the accompanying drawing.

FIGS. 1, 2 and 3 are a side elevation, a plan view and an axial sectional view respectively of an embodiment of the device in accordance with the invention; the axial sectional view of FIG. 3 is taken on the line III—III in FIG. 2; and FIG. 4 is a perspective view of the nut used on the clamping bolt.

Referring to FIGS. 1 to 3 reference numeral 1 designates a square chisel block of conventional structure. Each side face has an outwardly converging fastening slot 2. Into the fastening slot 2 is screwed a T-nut 3 of a clamping bolt 4 having a head 5. The chisel 6 is fixed in place with the aid of the bolt 4 with the interposition of a clamping plate 7. This clamping plate has a portion 8 bent over at right angles and being partly engaged in the slot 2. The portion 8 is provided with set screws 9 and 10 being at an angle of about 45° to the fastening slot 2. The shank of the chisel 6 is bifurcated to define an elongate slot 15 between the legs 16 and 17. The upper side face 11 of the leg 16 is tapered from the free end of the leg 16 to the point 18 so that the leg 16 is wedge shaped, being of greatest width at its free end. In order to fix the clamping bolt 4 in place the set screws 9, 10 are brought into contact with the tapered side face 11 so that the cutting edge of the chisel 6 occupies the correct position with respect to the chisel block 1 and thereby cuts along the circuit cutting path 19 when the block 1 is rotated. Subsequently the bolt 4 is tightened in this position. Whilst the bolt is being tightened, the position of the cutting edge 12 of the chisel 6 adjusted by the set screws 9 and 10 remains unchanged. According to the invention the portion 8 is provided on the lower side with safety cams 13, 14 which cooperate with the set screw to grip behind the converging side faces of the fastening slot 2. When the set screw 20 is bottomed in the slot 2, the cams 13, 14 are forced against the corresponding faces of the slot thus holding the device in a radial direction. Even if the bolt 4 should break down, the chisel 6 is safely held in place.

Owing to the provision of the cams 13, 14 only a chisel of given thickness can be mounted. In the prior art devices the thickness of the chisel is not subjected to limitations, so that there has been the risk of using a chisel of such a thickness that the fastening nut could not be screwed onto the bolt throughout its length.

It should be noted that in the device according to the invention very broad chisels may be employed, which can be fixed in place with the aid of a plurality of fastening bolts extending through parallel slots in the chisel. In such a case a plurality of safety faces 11 are used.

What I claim is:

1. A fastening device for securing a wood working chisel to a rotatable chisel block having a fastening slot therein, which comprises a clamping plate adapted to sandwich the chisel between it and the chisel block and having an opening, a bolt extending through said opening and a nut captive within said slot and engaged with said bolt, said clamping plate including a lateral extension projecting into said slot and provided with cam portions engaged against the block within said slot, a set screw carried by said lateral extension and bottomed in said slot to force said cam portions against the block and fix said clamping plate relative to said block.

2. A fastening device as defined in claim 1 wherein said chisel is provided with a wedge surface and said clamping plate is provided with further set screws engaging said wedge surface.

3. A fastening device as defined in claim 2 wherein said further set screws lie in a plane inclined with respect to the chisel block and transverse to the direction of said fastening slot thereby to force the chisel against the block even in the absence of clamping force exerted by said bolt.

4. A fastening device for fastening a wood working chisel to a rotatable chisel block of a wood working machine, which comprises a clamping plate having an opening therein for receiving a clamping bolt, said clamping plate including a lateral extension adapted to project into a fastening slot in a chisel block, said extension having oppositely directed cam portions adapted to engage the chisel block within the fastening slot, a set screw carried by said extension and adapted to bottom within the fastening slot to force said cam portions against the block thereby to fix the clamping plate relative to the block, and further set screws carried by said clamping plate adapted to engage the chisel.

5. A device as defined in claim 4 wherein said further set screws lie in a plane inclined with respect to a plane containing the first mentioned set screw thereby to force the chisel against the block.

* * * * *